United States Patent [19]

Artindale

[11] Patent Number: 4,832,520

[45] Date of Patent: May 23, 1989

[54] BOOK SPINE LABEL

[76] Inventor: James S. Artindale, 1059 Maitland Drive N. E., Calgary, Alberta T2A 5K1, Canada

[21] Appl. No.: 104,418

[22] Filed: Oct. 2, 1987

[51] Int. Cl.[4] ..... B42F 13/00; B42F 13/10

[52] U.S. Cl. ..... 402/3; 402/80 R

[58] Field of Search ..... 402/3.80 R; 40/16.2

[56] References Cited

U.S. PATENT DOCUMENTS

| | | | |
|---|---|---|---|
| 1,843,542 | 2/1932 | Dawson | 402/3 |
| 3,066,680 | 12/1962 | Duncan | 40/16.2 |
| 3,335,508 | 8/1967 | Hummel | 402/3 |
| 4,596,482 | 6/1986 | Salzer | 402/3 |

FOREIGN PATENT DOCUMENTS

| | | |
|---|---|---|
| 69047 | 10/1900 | Canada . |
| 99520 | 6/1906 | Canada . |
| 188059 | 12/1918 | Canada . |
| 278460 | 3/1928 | Canada . |
| 491642 | 3/1953 | Canada . |
| 551443 | 1/1958 | Canada . |
| 674239 | 11/1963 | Canada . |
| 703246 | 2/1965 | Canada . |
| 756307 | 4/1967 | Canada . |
| 768853 | 10/1967 | Canada . |
| 1118995 | 3/1982 | Canada . |

*Primary Examiner*—Paul A. Bell

*Attorney, Agent, or Firm*—Rodman & Rodman

[57] ABSTRACT

The invention relates to a new article of manufacture consisting of a label means, such as label holder, for identifying or indexing printed matter or the like bound with a conventional tubular ring plastic binder consisting of a spine from which a series of generally evenly spaced plastic tangs extend in a curvilinear manner describing a complete loop terminating under the said binder spine. The other side of the spine is generally straight and smooth. One such binder is commercially available under the "Cerlox" and "Surelox" trade marks. The specification discloses a label means comprising: a central panel adapted to overlie at least a portion of the binder spine, and two side flanges, each said flange being defined by a respective longitudinal crease; wherein a first said side flange is provided with a series of apertures along the longitudinal crease associated therewith, the said apertures being adapted to permit the entry of the binder tangs; wherein the first side flange is adapted to fold around and underlie the first side of the spine; and wherein the second side flange is adapted to fold around and underlie the straight second edge of the binder spine.

12 Claims, 1 Drawing Sheet

BOOK SPINE LABEL

This invention relates to a new article of manufacture consisting of a label means, such as label holder, for indentifying or indexing printed matter or the like bound with a conventional tubular ring plastic binder consisting of a spine from which a series of generally evenly spaced plastic tangs extend in a curvilinear manner describing a complete loop terminating under the said binder spine. The other side of the spine is generally straight and smooth. One such binder is commercially available under the "Cerlox" and "Surelox" trade marks.

The invention provides a solution to the problem of labelling these widely used tubular ring plastic binders. Prior to this invention, there were two well-known ways to obtain labelled tubular ring plastic binders. The first way was by directly embossing identification characteristics onto the plastic binder spine itself. An alternative way was to secure a label on the binder spine by using adhesives, external spring clips, or the like. For example, plastic strips with embossed identification characteristics created with an embossing gun were affixed to the binder spine.

Characters or symbols embossed directly on the tubular plastic binder spine either wear off with time, or permanently mark the binder, limiting any revision of the label.

Labelling involving adhesives is generally unsatisfactory, as it is messy and may not be completely permanent. Adhesive labels are subject to wear and over time they tend to lose their adhesion.

In contrast to the foregoing, the present invention permits great flexibility in the design and pattern of the label itself, as it is printed independently of the tubular plastic binder. In one embodiment the present invention is a label holder adapted to retain a label.

Figure 1:
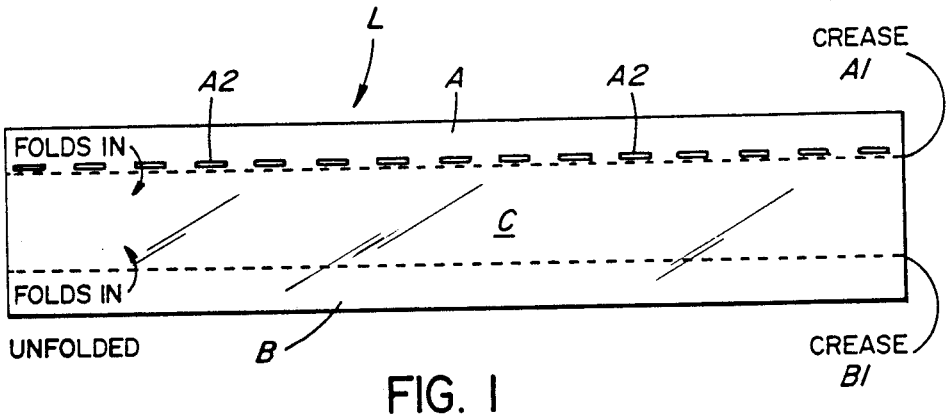
Figure 2:
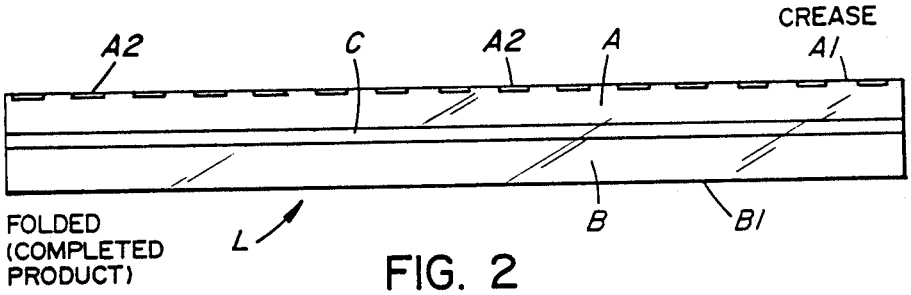
Figure 3:
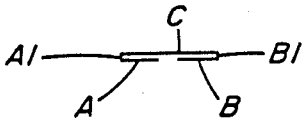
Figure 4:
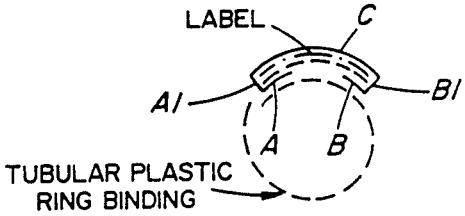
Figure 5:
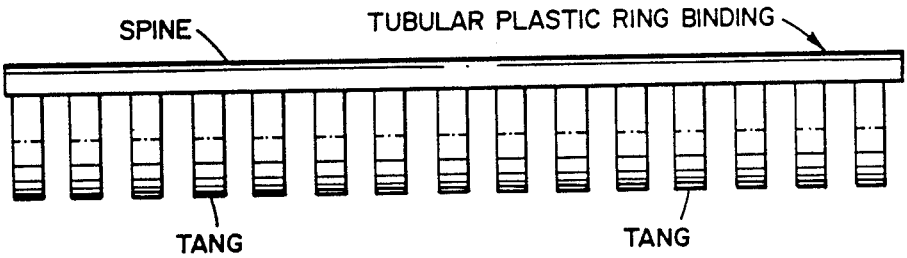

In the Drawings which form a part of this specification:

FIG. 1: is a plan view of the unfolded label holder in its unfolded intermediate condition;

FIG. 2: is a plan view of the folded label holder in the folded (completed) condition;

FIG. 3: is an end view of the label holder of FIG. 2;

FIG. 4: is an end view of a tubular ring plastic binder and the label holder of the present invention;

FIG. 5: is a side view of a typical tubular ring plastic binder.

The label means L, as illustrated, is suitably constructed out of a generally elongated rectangular piece of transparent or translucent plastic material. The label means L generally comprises three portions, i.e. a central panel C, and two side flanges A and B, each one defined by a respective longitudinal crease A1, B1, creases A1, B1 being, as shown, parallel to and spaced inwardly of the longitudinal edges of the rectangular piece of plastic material. As illustrated, side flange A is provided with a series of apertures A2 along its crease line A1, the said apertures being in the form of rectangular slots corresponding to and adapted to permit the entry of the binder tangs. The other side flanges B, in use, folds around the straight edge of the binder spine along its corresponding crease line B1. The central panel C extends along and envelops a varying desired length of the visible portion of the binder spine.

In one embodiment of the present invention, the label means L is generally of the same length as the tubular ring plastic binder thereby allowing the label to run the entire length of the tubular ring plastic binder.

The thickness of the plastic label means L is variable within reasonable limits. It should be flexible enough to permit the plastic to conform to the curvature of the tubular ring plastic binder. Any suitable plastic material may be used provided that the creases A1, B1 once formed, remain as permanent parts of the label structure. Creases A1, B1 are provided by the manufacturer and the label means is usually supplied in the fully folded condition shown in FIGS. 2, 3 and 4.

In a preferred embodiment of the present invention, the label means is a transparent or translucent label holder. The center panel C of the label holder overlies and retains the label in a visible condition as in FIG. 4.

In another embodiment of the present invention, the label means L may be constructed of a plastic material exhibiting an outer surface receptive to marking whereby the label means displaying such outer surface characteristic could be produced in quantity and then installed on the tubular ring plastic binders. With a surface receptive to marking, the label means could be marked with, for example, a ball point pen or a felt marker or similar writing instrument.

In a preferred embodiment of the present invention, the central panel C of the label means is of a width just slightly more than the width of the tubular ring plastic binder spine so as to allow the two side flanges A and B to fold around the binder spine in a close fit. Thereby, the label means neatly envelops the binder spine.

In its embodiment as a label holder as illustrated in FIG. 4, the present invention permits a label to be installed, removed and replaced extremely quickly without any equipment or tools. The label contained underneath the label holder is permanently retained and protected by the label holder.

This label means L may be affixed to the tubular plastic binding in the following manner prior to any materials being bound with the said binding.

(1) The tubular plastic binding is held open.

(2) The free ends of the tangs of the tubular plastic binder are inserted between side flange A and the central panel C and then through the corresponding rectangular apertures A2 along crease line A1, continuing the penetration until the base of the tangs (which adjoin the spine of the tab plastic binder) contacts the crease line A1;

(3) The desired label or other insert is then placed along the spine of the tubular plastic binder, which is then covered or overlaid by the central panel C of the label means.

(4) Side flange B is tucked underneath the side of the spine of the tubular plastic binder opposite the side to which the tangs are attached. When materials are bound in a tubular plastic binder to which this item is properly attached, flange B would lie between the underside of the spine and the free ends of the tangs of the tubular plastic binder. Crease line B1 fits snugly along this edge of the tubular plastic binder spine.

(5) When used as a label holder, the label means L permits easy revision or replacement of the label. In order to remove or change the label, side flange B must simply be pulled out from under the binder spine. A new label can then be placed between the center panel C and the spine of the tubular plastic binder and then side flange B is retucked under the side edge of the binder spine.

Flange A may be smaller in width than flange B, and in fact may be just large enough to be held in place by the tangs. Each aperture A2 may be joined to the outer edge of flange A by a slit or the like, for placement on the respective tangs, in one variation.

I claim:

1. A label means of resilient material for mounting on a tubular ring plastic binder having a spine, a series of tangs in predetermined positions extending from a first side of the spine, a second side of the spine being generally straight, and said tangs curving around and, in use, the free ends of the tangs being disposed beneath said spine and closely adjacent thereto, said label means comprising; a central panel adapted to overlie at least a portion of the outer surfaces of the binder spine, and two side flanges, each said flange being defined by a respective longitudinal crease; wherein a first said side flange is provided with a series of apertures along the longitudinal crease associated therewith, the said apertures being adapted to be penetrated by the binder tangs for secure pivotal connection of the spine and central panel along said first side; wherein the first side flange is adapted to fold around the first side of the spine and underlie the inner surface of said spine and wherein the second side flange is adapted to fold around the straight second edge of the binder spine and underlie the inner surface of said spine for disengagable connection with said second edge.

2. A label means as claimed in claim 1 comprising a unitary element constructed of transparent or translucent plastic material.

3. A label means such as claimed in claim 2, for use with a binder with a predetermined width, wherein the central panel is of a width slightly more than the width of the binder spine so as to allow the two side flanges to fold around and underlie the visible portion of the binder spine, and envelop the same in a close fit.

4. A label holder of resilient material for mounting on a tubular ring plastic binder having a spine, a series of tangs extending in predetermined positions from a first side of the spine, a second side of the spine being generally straight and said tangs curving around in a complete loop and terminating beneath said spine and closely adjacent thereto, said label holder comprising: a central panel adapted to overlie at least a portion of the outer surface of the binder spine , and two side flanges, each of said flanges being folded inwardly along a respective longitudinal crease; against the inner surface of the binder spine wherein a first said side flange is provided with a series of apertures along its associated longitudinal crease, the said apertures corresponding to, and adapted to be penetrated by the binder tangs to provide secure pivotal connection of the spine and central panel along said first side fold around and underlie the first side of the spine; and the second side flange being adapted to provide a disengagable connection between the central panel and the second edge at least a substantial part of the central panel of said label holder being constructed of transparent or translucent plastic material adapted to receive and display a label interposed between the spine and the central panel.

5. A label holder such as claimed in claim 4 for use with a binder having a predetermined width wherein the central panel of the label holder is of a width just slightly more than the width of the binder spine so as to allow the two side flanges of the label holder to fold around the binder spine and envelop the same in a close fit.

6. A label holder as in claim 4 comprising a unitary element constructed entirely of transparent plastic material.

7. A label holder as in claim 4 in which each aperture is adapted to receive and closely engage a single tang.

8. A label holder as in claim 4 in which the second side flange extends substantially the full length of the central panel.

9. A label holder as in claim 4 in which said aperture is adapted to receive and closely engage a single tang and in which the central panel and the second side flange extends substantially the full length of the spine, said spine being of predetermined length.

10. A label holder as in claim 4 in which the spine is of predetermined length and the central panel is of substantially the same length.

11. The combination of a tubular ring, plastic binder and a label holder, said tubular ring and plastic binder comprising a spine, a series of tangs extending from a first side of a spine, a second side of the spine being generally straight and said tangs curving around, and, in use, the free ends of the tangs being disposed beneath said spine and closely adjacent thereto, said label holder comprising a generally rectangular sheet of resilient plastic extending longitudinally of the outer surface of said spine substantially its entire length, an aligned series of slits extending longitudinally adjacent a first lateral side of said rectangular sheet, each of said slits engaging at least one tang to provide a secure pivotal connection between the plastic binder and the label holder, a second lateral side of said rectangular sheet having a section extending a substantial longitudinal distance overlapping a plurality of tangs and being folded over and under the second side of the spine to give a detachable engagement, at least part of said rectangular sheet being transparent or translucent adapted to display a label sandwiched between the spine and rectangular sheet.

12. A label holder for mounting on a tubular plastic binder having an elongated spine with an outer surface and inner surface, and a series of spaced tangs extending from a first longitudinal side of the spine and curving around toward an opposite second longtidinal side of the spine, the tangs having free ends disposed beneath the inner surfce of the spine at the second longitudinal side, said label holder comprising a generally rectangular sheet of plastic material of predetermined longitudinal extend for disposition on the outer surface of said spine, an aligned series of spaced apertures extending longitudinally of the first lateral side of said rectangular sheet, the spacing of said apertures corresponding to the spacing of said tangs such that each of said apertures engages a corresponding said tang to provide a secure pivotal connection between the plastic binder and the label holder, a second lateral side of said rectangular sheet having a foldable longitudinal section extending a selected longituidnal distance for folding between corresponding free ends of said tangs and the second side of the spine to provide a detachable engagement, at least a portion of said rectangular sheet being transparent or translucent to display a label sandwiched between the spine and the rectangular sheet.

* * * * *

UNITED STATES PATENT AND TRADEMARK OFFICE

CERTIFICATE OF CORRECTION

PATENT NO. : 4,832,520

DATED : May 23, 1989

INVENTOR(S) : James S. Artindale

It is certified that error appears in the above-identified patent and that said Letters Patent is hereby corrected as shown below:

At column 1,
line 62, change "flanges" to --flange--.

At column 3,
lines 54 and 55, delete "fold around and underlie the first side of the spine; and".

At column 4,
line 11, change "said" to --each--.
line 44, before "inner", insert --an--.
line 46, change "longtidinal" to --longitudinal--.
line 48, change "surfce" to --surface--.
line 51, change "extend" to --extent--.
line 60, change "longituidnal" to --longitudinal--.

Signed and Sealed this

Thirteenth Day of February, 1990

*Attest:*

JEFFREY M. SAMUELS

*Attesting Officer* *Acting Commissioner of Patents and Trademarks*